United States Patent [19]

Ozaki

[11] Patent Number: 4,788,524

[45] Date of Patent: Nov. 29, 1988

[54] THICK FILM MATERIAL SYSTEM

[75] Inventor: Thomas Ozaki, Sycamore, Ill.

[73] Assignee: GTE Communication Systems Corporation, Phoenix, Ariz.

[21] Appl. No.: 90,192

[22] Filed: Aug. 27, 1987

[51] Int. Cl.[4] ..... H01C 1/012

[52] U.S. Cl. ..... 338/309; 338/195; 338/308; 338/275; 338/324

[58] Field of Search ..... 338/308, 309, 314, 195, 338/275, 322, 324, 327, 328, 330, 332–334; 252/514, 518

[56] References Cited

U.S. PATENT DOCUMENTS

| | | | |
|---|---|---|---|
| 3,621,442 | 11/1971 | Racht et al. | 338/309 |
| 3,761,860 | 9/1973 | Ogiasawara et al. | 338/309 X |
| 4,041,440 | 8/1977 | Davis et al. | 338/195 |
| 4,205,297 | 5/1980 | Johnson et al. | 338/195 |
| 4,306,217 | 12/1981 | Solow | 338/195 X |
| 4,362,656 | 12/1982 | Hormadaly | 338/308 X |
| 4,485,370 | 11/1984 | Poisel | 338/309 |
| 4,529,958 | 7/1985 | Person et al. | 338/195 X |
| 4,539,223 | 9/1985 | Hormadaly | 338/308 X |

*Primary Examiner*—C. L. Albritton

*Attorney, Agent, or Firm*—Anthony Miologos

[57] ABSTRACT

A material system for manufacturing thick film resistors on a ceramic dielectric substrate is disclosed. The system includes the application and fixing of resistor terminations composed of a precious conductor material to a dielectric substrate. Resistor material is deposited over portions of the resistor terminations and to the dielectric substrate intermediate the resistor terminations. Terminal pads, conductor traces and resistor interconnections are printed on the dielectric substrate using a base conductor material. The resistor interconnections are deposited and fixed to the resistor terminations and to portions of the resistor material. The resistor material is trimmed to tolerance by kerfing the resistor material and a dielectric encapsulant is applied substantially over the resistor interconnections and resistor material.

6 Claims, 1 Drawing Sheet

THICK FILM MATERIAL SYSTEM

BACKGROUND OF THE INVENTION

This invention relates in general to the manufacture of ceramic hybrid microcircuits and more particularly to a novel material system for making thick film resistors on a ceramic substrate.

Present methods utilized in the manufacture of the thick film resistors include a multi-stepped process which builds the resistors and interconnects on the substrate. This process first includes printing, drying and firing of a conductor material, normally palladium-silver (Pd-Ag), as pads, interconnects and terminations. Then, a Ruthenium based resistor material is printed on the substrate between the palladium-silver pads. The deposited resistor material is subsequently dried and fired. Next, a glass encapsulant is printed, dried and fired over the conductor pads and resistor. Finally, the the thick film resistor is laser trimmed to tolerance.

The major disadvantage of the process outlined above is material cost. Palladium-silver paste is generally expensive. Further, since it is a precious metal its cost is subject to wild and rapid market fluctuations. This price cost fluctuation provides difficulty in pricing circuits and budgeting for manufacturing cost.

The thick film industry has been searching for an alternative to precious metal conductors and as a result has developed base metal conductors, like copper, which can provide conductors with greater conductivity then with palladium-silver material. However, base metal conductors must be fired in a nitrogen atmosphere. Unfortunately, resistor paste technology still required the use of air firing.

In order to make the conductor firing compatible with the presently known resistor pastes, material manufactures developed low temperature firing copper conductors which can be used with air fired resistor technology. Air fired resistors compatible with the copper conductor material are not compatible with any nitrogen fired glass overcoats. Air fired overcoats cannot be used since air firing will result in oxidation of the copper film.

Encapsulants are required to provide long term stability to the thick film resistors of less than 0.25% ohms, per 1000 hours, at 150 degrees C. to 85 degrees C.

It therefor becomes an object of the present invention to provide a novel thick film material system for making thick film resistors using base metal conductors and encapsulation.

SUMMARY OF THE INVENTION

In accomplishing the object of the present invention there is provided a material system for manufacturing thick film resistors on a ceramic dielectric substrate.

The system includes the application and fixing of resistor terminations composed of a precious conductor material to the dielectric substrate. A resistor material is then deposited over portions of the resistor terminations and to the dielectric substrate intermediate the resistor terminations.

Terminal pads, conductor traces and resistor interconnections are then printed on the dielectric substrate using a base conductor material. The resistor interconnections are deposited and fixed to the resistor terminations and to portions of the resistor material.

Next, the resistor is trimmed to tolerance by kerfing the resistor material and a dielectric encapsulant is substantially applied over the resistor interconnections and resistor material.

BRIEF DESCRIPTION OF THE DRAWINGS

A better understanding of the invention may be had from the consideration of the following detailed description taken in conjunction with the accompanying drawings in which.

DESCRIPTION OF THE PREFERRED EMBODIMENT

Figure 1:
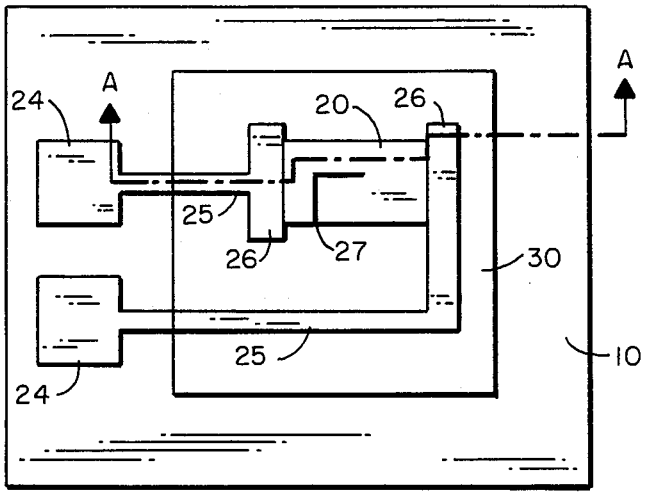
FIG. 1 is a top plan view of a thick film resistor deposited on a substrate in accordance with the present invention; and, FIG.2 is a sectional view taken substantially along line A—A of FIG. 1.
Figure 2:
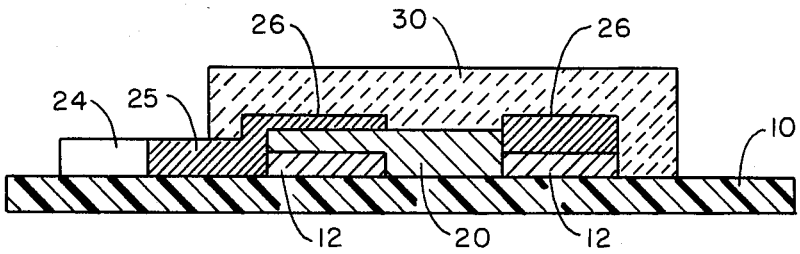

Turning now to FIGS. 1 and 2 of the included drawings the thick film material system of the present invention will be explained. A pair of palladium-silver (Pd-Ag) resistor terminations 12 are printed and dried on a ceramic substrate 10. The terminations are then fired in air at a temperature of 850 degrees C. A Ruthenium based resistor material 20 such DUPONT ® 1600, 1700 or 6300 series thick film resistor material is printed over terminations 12. Portions of terminations 12 are not covered by the resistor material 20 in order to accept the conductor material of the next step. The printed resistor material is dried and fired at 850 degrees C. in air.

A layer of a base metal conductor, such as copper, is printed on substrate 10 forming terminal pads 24, and conductor runs 25. The copper conductor is also applied over the resistor terminations 12 making a conductive connection between the uncovered portions of the resistor terminations 12 and the copper conductor as shown at FIG. 2. The copper is then allowed to dry and subsequently fired at 600 degrees C. in nitrogen.

The now formed resistor is kerfed, shown as 27, using a laser to trim the resistor to tolerance.

A dielectric overglaze 30 is next printed over the thick film resistor as shown. This overglaze such as the MINICO M-7000 TM is polymer based and curable using an infrared light source or conventional oven at 200 degrees C. in air. The polymer encapsulation has advantageous over conventional glass encapsulation in that moisture is not trapped within the encapsulant during the curing process. The trapped moisture leads to fluctuations in the ohmic value of the thick film resistor. The infrared curable encapsulant allows for a long term resistor stability of less than 0.25%, per 1000 hours, at 150 degrees C. to 85 degrees C.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. A material system for manufacturing thick film resistors on a ceramic dielectric substrate comprising:

at least first and second resistor terminations located in a spaced relationship to one another and fixed to said dielectric substrate, said resistor terminations composed of a palladium-silver conductor material.

a ruthenium based resistive material fixed to portions of said first and second terminations and to said dielectric substrate;

at least first and second terminal pads fixed to said dielectric substrate, and first and second conductor traces extending from said first and second terminal pads respectively to at least first and second resistor interconnections respectively, said first and second resistor interconnections fixed to said first and second resistor terminations and to portions of said resistive material, said first and second terminal pads, first and second conductor traces and first and second resistor interconnections composed of a copper conductor material; and, an infrared heat curable dielectric polymer encapsulant applied and cured substantially over said first and second resistor interconnections and resistive material.

2. The material system for manufacturing thick film resistors claimed in claim 1, wherein: said resistive material is trimmed to tolerance before said encapsulant is applied over said resistive material.

3. The material system for manufacturing thick film resistors claimed in claim 2, wherein: said resistive material is trimmed to tolerance by kerfing said resistive material.

4. A material system for manufacturing thick film resistors on a ceramic dielectric substrate comprising:

resistor terminations composed of a palladium-silver conductor material fixed to said dielectric substrate;

a ruthenium based resistor material fixed to portions of said resistor terminations and to said dielectric substrate;

terminal pads fixed to said dielectric substrate, and conductor traces extending from said terminal pads to resistor interconnections, said terminal pads, conductor traces and resistor interconnections composed of a copper conductor material, and said resistor interconnections fixed to said resistor terminations and to portions of said resistor material; and, a dielectric polymer encapsulant applied and fixed substantially over said resistor interconnections and resistive material.

5. A material system for manufacturing thick film resistors on a ceramic dielectric substrate comprising:

resistor terminations composed of a palladium-silver conductor material fixed to said dielectric substrate;

a ruthenium based resistor material fixed to portions of said resistor terminations and to said dielectric substrate;

terminal pads fixed to said dielectric substrate, and conductor traces extending from said terminal pads to resistor interconnections, said terminal pads, conductor traces and resistor interconnections composed of a copper conductor material, and said resistor interconnections fixed to said resistor terminations and to portions of said resistor material;

said resistor material is trimmed to tolerance; and, an infrared heat curable polymer encapsulant applied and cured substantially over said resistor interconnections and resistor material.

6. The material system for manufacturing thick film resistors claimed in claim 5, wherein: said resistor material is trimmed to tolerance by kerfing said resistor material.

* * * * *